United States Patent [19]

Bauer et al.

[11] Patent Number: 4,555,085

[45] Date of Patent: Nov. 26, 1985

[54] LOCKABLE TILTING APPARATUS FOR CHAIR SEATS

[75] Inventors: Fritz Bauer, Schulzstrasse14, D-8503 Altdorf; Hans-Peter Bauer, Altdorf; Hans Jürgen Bauer, Altdorf-Röthenbach, all of Fed. Rep. of Germany

[73] Assignees: Fritz Bauer; Söhne oHG, both of Altdorf, Fed. Rep. of Germany

[21] Appl. No.: 442,190

[22] Filed: Nov. 16, 1982

[51] Int. Cl.[4] ..... F16M 13/00

[52] U.S. Cl. ..... 248/561; 248/371; 297/304; 297/310

[58] Field of Search ..... 248/561, 371, 372.1, 248/398, 178; 297/304, 306, 374, 310

[56] References Cited

U.S. PATENT DOCUMENTS

| | | | |
|---|---|---|---|
| 3,065,828 | 11/1962 | Caldemeyer | 248/561 X |
| 3,656,593 | 4/1972 | Bauer . | |
| 3,711,054 | 1/1973 | Bauer . | |
| 3,995,824 | 12/1976 | Bauer . | |
| 4,283,033 | 8/1981 | Bauer . | |
| 4,384,741 | 5/1983 | Flum et al. | 297/304 |
| 4,390,206 | 6/1983 | Faiks, et al. | 248/561 X |

FOREIGN PATENT DOCUMENTS 2432248 1/1976 Fed. Rep. of Germany .

*Primary Examiner*—J. Franklin Foss
*Assistant Examiner*—David L. Talbott
*Attorney, Agent, or Firm*—Browdy and Neimark

[57] ABSTRACT

A lockable tilting apparatus for the seats of chairs and which can be used selectively either for chairs which tilt backward or for chairs which tilt forward, comprising a base plate securable to chair seat and a stationary body member adapted to be supported by the pedestal of the chair, spring means supported by said stationary body member, means supported by said stationary body member mounting said base plate for tilting pivotal movement relative to said stationary body member, link means engaging and movable with said base plate against the restoring force of said spring means whereby said base plate is tiltably movable relative to said body member against the restoring force of said spring means; and wherein a locking apparatus which is actuatable by displacement of an operating lever between two terminal positions is provided for selectively locking the base plate against tilting movement or for releasing the base plate for tilting movement, characterized by a slide member mounted in said body member for sliding movement relative to said base plate, said slide member being selectively movable between said two terminal positions, said slide member having receptacle means for engagement by an operating lever whereby to effect movement of said slide member selectively between said two terminal positions, said receptacle means being accessible for engagement by said operating lever from either of two laterally opposite sides of said body member. This construction permits the tilting apparatus to be mounted on either chairs which tilt backward or on chairs which tilt forward.

20 Claims, 6 Drawing Figures

LOCKABLE TILTING APPARATUS FOR CHAIR SEATS

FIELD OF THE INVENTION

This invention relates to a lockable tilting apparatus for chair seats, the tilting apparatus including a base plate which can be secured to a chair seat; and means forming part of the tilting apparatus for permitting tilting movement of the base plate and of the chair seat connected thereto about an axis in a direction counter to the restoring force of a spring; the tilting apparatus is supported by the pedestal of the chair; and a locking device is provided which selectively either locks the base plate and attached chair seat against tilting movement or alternatively releases the base plate and attached chair seat for tilting movement when an operating lever is moved between two terminal positions.

BACKGROUND OF THE INVENTION

In a tilting apparatus of this kind know from German laid-open application DE-OS No. 24 32 248, the operating lever is held in place in a crank guided in the tilting body, and a drag lever articulated on the crank in turn displaces a locking device, by means of which the holder plate and tilting body can be connected firmly with one another or unlocked. The crank is disposed in a vertically movable release lever, by means of which a releasing pin of a longitudinally displaceable gas spring can be actuated. The gas spring is part of a chair column which is adjustable in height. This known lockable tilting apparatus can be used for so-called executive chairs, the seat of which can be inclined backward by a predetermined angle when the locking device is released. It is also known to use locking apparatuses of fundamentally the same design for chairs having a seat that can be tilted forward when the locking device is released. This latter application relates primarily to so-called secretarial chairs. Each of these tilting apparatuses is suitable for only one of these types of chair; that is, they are tiltable in only one direction.

SUMMARY OF THE INVENTION

It is accordingly a principal object of the invention to embody a tilting apparatus of the type described above such that it can be selectively used for either chairs that tilt backward or chairs that tilt forward.

This object is attained in accordance with the invention as disclosed in the claims. The primary characteristic of the invention is that the operating lever can be selectively placed from either side into the slide disposed in the tilting apparatus in a displaceable manner, this placement of the operating lever naturally being in the direction of displacement of the slide. The tilting apparatus can thus be used selectively for either of the intended directions of inclination. In either case the operating lever is located underneath the chair such that it is accessible to the user. The invention further provides that precise guidance of the operating lever for its displacement movements is attained. The bearing openings furthermore serve simultaneously to support the operating lever, should the operating lever be intended to execute pivoting movements; that is the case, for instance, if a release pin of a gas spring, which is part of a chair column that is adjustable in height, is also simultaneously actuated by means of the slide, as is provided in the prior art.

By means of a further provision according to the invention, it is attained in a simple manner that the operating lever retains its given position and can also be exchanged easily for another. A particularly easily operated locking mechanism for the operating lever in the slide is disclosed as well.

In accordance with further characteristics of the invention, the slide is both simply guided and displaced in a particularly reliable manner, and this displacement is in precisely the best possible direction. The invention further discloses how the slide is held in two terminal positions that are perceptible to the user. Further provisions of the invention assure the continued satisfactory operation of the slide even during pivoting movements, when the height of the chair is being adjusted.

The invention further provides a locking device that is adapted particularly well to the slide to which an operating lever can be attached selectively from either side. A further embodiment provides that in the locked position, the holder plate and thus the seat as well have no pivoting play relative to the tilting apparatus; nevertheless, the required actuation force for displacing the operating lever with the slide is not disproportionately great.

According to the invention it is also possible, in a simple manner, to use the slide additionally, and as already mentioned, for actuating a releasing pin of a gas spring which is adjustable in height and is part of the chair column.

Further advantages and characteristics of the invention will be understood from the ensuing description of an exemplary embodiment, taken in conjunction with the drawings.

DESCRIPTION OF THE PREFERRED EMBODIMENT

Figure 1:
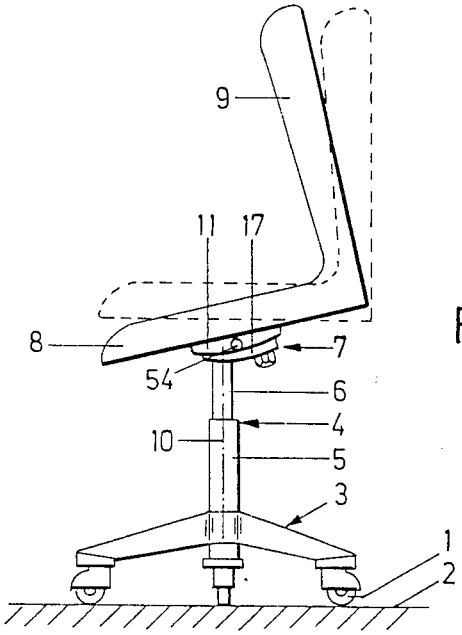
FIG. 1 shows a chair that can be tilted forward and is provided with a tilting apparatus according to the invention.

The typing chair shown in FIG. 1 has a pedestal 3, which is movable on casters 1 supporting it with respect to the floor 2. A chair column 4 which is adjustable in height is attached centrally to the pedestal 3 and comprises a guide tube 5 and a gas spring 6, which is accommodated in the guide tube and is adjustable in length. Adjustable-length gas springs 6 of this type are known, for instance from German Pat. No. 18 12 282 (corresponding to U.S. Pat. No. 3,656,593). The usage of these gas springs together with a guide tube 5 as chair columns 4 is known, for instance from German Pat. No. 19 31 012 (corresponding to U.S. Pat. No. 3,711,054), to which reference is made in order to avoid repetition. A tilting apparatus 7 which will be described in greater detail below is secured to the upper end of the gas spring 6 and is also secured to the underside of a chair seat 8, to which a chair back 9 may be firmly attached if desired. As may be seen from FIG. 1, the chair seat 8 is tiltable together with the chair back 9 out of a normal sitting position indicated by dashed lines and into a position that has been tilted forward. Tilting positions of this kind are provided for typing chairs, for instance.

Figure 2:
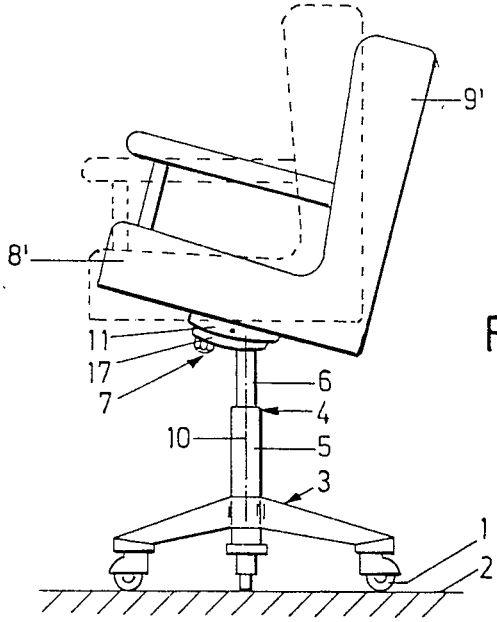
FIG. 2 shows a chair that can be tilted backward and is provided with a tilting apparatus according to the invention.

The chair shown in FIG. 2 is a so-called executive chair, the chair seat 8' of which, with the chair back 9', can be inclined or tilted out of a normal sitting position indicated by dashed lines and into a position that has been tilted backward. As may be seen from the drawing, the tilting apparatus 7 in this embodiment is disposed pivoted by 180° about the axis 10 of the chair column 4 as compared with the embodiment shown in FIG. 1. Otherwise the design is the same as in FIG. 1, so that identical reference numerals can be used, and the description need not be repeated.

The tilting apparatus has a base plate 11 of sheet steel in the form of an elongated rectangle. Ribs 12 are bent vertically downward at either long side of the base plate 11. In the vicinity of the corners, securing bores 13 are provided, serving for the passage therethrough of fastening screws 14, by means of which the chair seat 8 or 8' is secured to the base plate 11.

The tilting apparatus includes a stationary body 17 supported by gas spring 6.

A pair of bearing bores 15 disposed opposite one another and in alignment with one another is provided in the ribs 12 of base plate 11 for receiving bolt 18 about which base plate 11 and chair seat 8 are tiltably movable relative to body 17.

The body 17 is cast, for instance from aluminum, and includes a conical receptacle 19 for the correspondingly conical upper end of the gas spring 6, so that it is possible to establish a firm clamping connection between the body 17 and the gas spring 6. A releasing pin 20 for effecting an adjustment in length of the gas spring protrudes in the conventional manner from the upper end of the gas spring 6.

Figure 3:
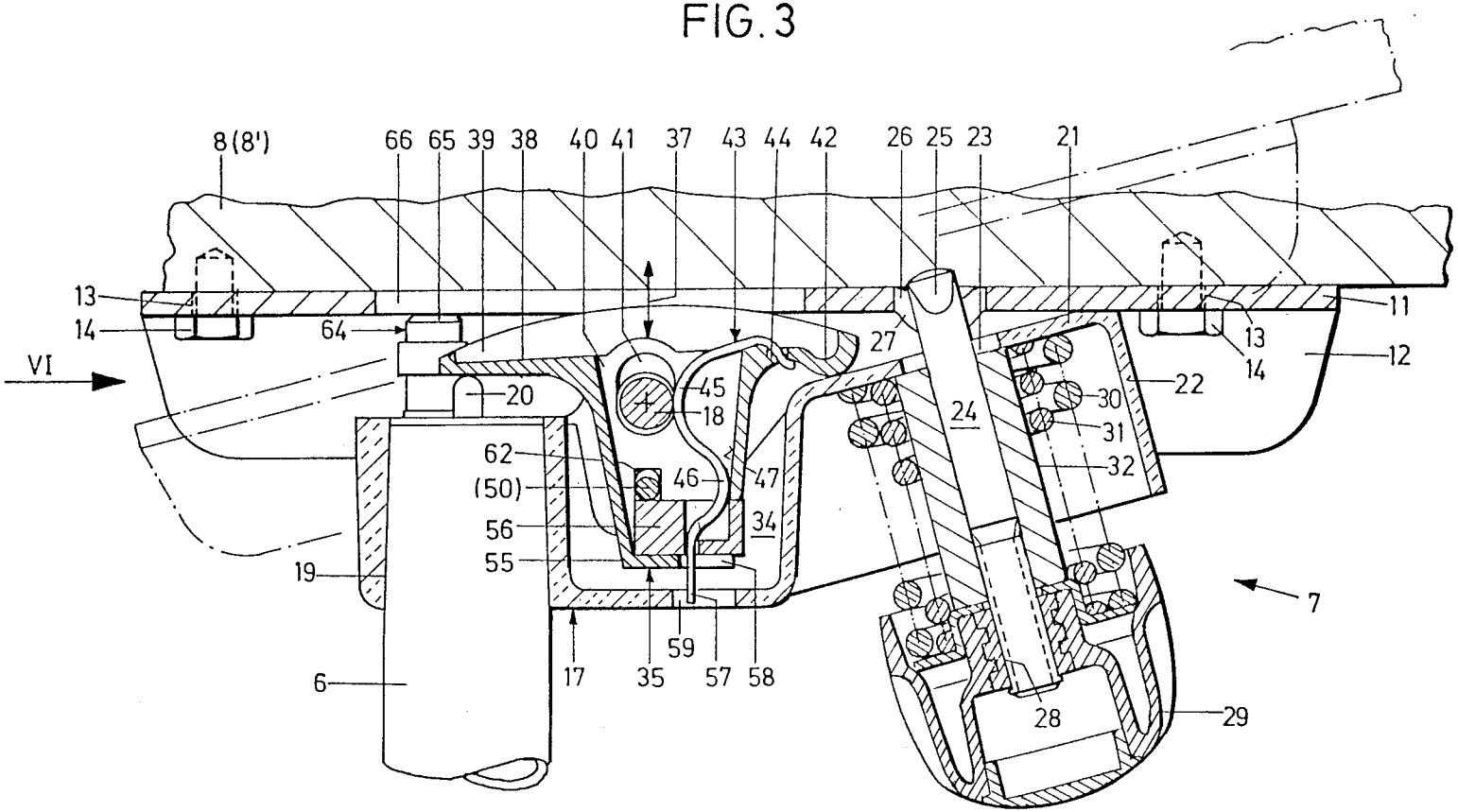
FIG. 3 is a vertical, longitudinal section taken through the tilting apparatus along the line III—III of FIG. 4.

The body 17 is furthermore provided with a spring support 21, which is provided laterally with a cup shaped limiting wall 22 open at the bottom. In the substantially platelike support 21, there is an opening 23 through which a pendulum bolt 24 is passed; with an upper crosspiece 25, the pendulum bolt 24 is pivotably supported in a depressed bearing surface 26 in the top of the base plate 11, and the bolt 24 is guided through an opening 27 in the base plate 11 and through the opening 23 of the support 21. The lower, free end of the pendulum bolt 24 is provided with a thread 28, onto which a tensioning nut 29 embodied like a rotary knob is threaded. Two helical springs 30, 31 disposed inside one another are disposed, wound in opposite directions, between the tensioning nut 29 and the spring support 21. A shock-absorbing and damping member 32, for instance of polyurethane foam, is disposed on the pendulum bolt 24 and inside the springs 30, 31; the damping member 32 likewise rests at one end against the spring support 21 and on the other end against the tensioning nut 29. By the suitable selection and dimensioning of the springs 30 and 31 and of the shock-absorbing and damping member 32, on the one hand, and by the appropriate prestressing of the rotary-knob-like tensioning nut 29 on the other, the forces counteracting a pivoting of the base plate 11 about the axial bolt 18 from the position shown in solid lines in FIG. 3 into the tilted position of the base plate 11 shown in dashed lines can be adjusted appropriately. Since the body 17 is firmly connected with the gas spring 6, it does not vary its position. The maximum inclination of the base plate 11 shown in dashed lines in FIG. 3 is fixed by a stop face 33, which is provided on the body 17 in the vicinity of the receptacle 19 for the gas spring 6.

A recess 34 which is open at the top is provided in the body 17, and a slide 35 is disposed in the recess 34 such that it is displaceable horizontally in a direction 36 on the axial bolt 18 and is pivotable vertically in the direction 37. As is particularly shown in FIG. 3, the slide 35 has an upper actuation tongue 38, which in all the positions of displacement rests on the releasing pin 20 of the gas spring 6 in the direction of displacement 36. The slide 35, which is reinforced on its top with ribs 39, has a ribbed wall 40 in the vicinity of its middle. An oblong slot 41 extending approximately in the pivoting direction 37 is embodied in the ribbed wall 40, and the axial bolt 18 is guided through this slot 41. The smaller diameter of the oblong slot is only slightly larger than the diameter of the axial bolt 18, so that the slide 35 is guided in a substantially play-free manner in the displacement direction 36 but is movable in accordance with the pivoting direction 37. In order to permit the execution of such pivoting movements, the slide 35 is supported, on its end remote from the actuation tongue 38 for the releasing pin 20, on the support 21 by means of a groove-like, molded-on bearing surface 42.

A wire spring 43 curved into an approximate S shape is disposed in the slide 35 and is fixed with its upper end in an opening 44 in the slide 35 adjacent to the bearing surface 42. This spring 43 rests with its upper curve 45 against the axial bolt 18. With its lower curve 46, it rests against an associated inner wall 47 of the slide 35. Two recesses 48, 49 in the form of annular grooves are disposed spaced apart from one another on the axial bolt 18, and in the two terminal positions of the slide 35, depending on its displacement direction 36, the upper curve 45 of the spring 43 engages these recesses 48, 49; as a result, the slide 35 is releasably engaged in the two terminal positions.

An operating lever 50 can be secured in the lower part of the slide in the manner now to be described. In a common vertical plane with the axial bolt 18, or in other words parallel to and below it, openings 53 which are in alignment with one another are embodied in the two lateral walls 51, 52 of the body 17; the operating lever 50, which is substantially in the form of a round rod and has a handle 54, can be introduced into these openings 53 from either side. In a lower, central holding section 55 of the slide 35, a locking bolt 56 is disposed such that it is displaceable in the displacement direction 36. This locking bolt 56 is pierced by a lower end section 57 of the spring 43 adjoining the lower curve 46 of the spring 43, and this section 57 presses the locking bolt 56 into a locking position, shown in FIG. 3 on the left. This end section 57 protrudes downward through corresponding recesses 58, 59 in the slide 35 or in the body 17. It is thus accessible from below and can be pressed—in FIG. 3, toward the right—in order to release the locking bolt 56.

The operating lever 50 is provided on its free end with a flattened zone 60 and has a lower locking recess 61. The flattened zone 60 of the operating lever 50 may be introduced into an appropriately adapted receptacle 62, associated with one end of the locking bolt 56, in the holding section 55 of the slide 35 in fact from either side, as already noted; that is, it can be introduced either through the lateral wall 51 or through the lateral wall 52. In order to do so, the locking bolt 56 is displaced out of the position shown in FIG. 3 by means of a corresponding elastic displacement of the end section 57 of the spring 43, so that the flattened zone 60 of the operating lever 50 can be pushed into the receptacle 62. The end section 57 is then released, as a result of which the locking bolt 56 is displaced back into the locking position shown in FIG. 3. While the slide 35 is preferably of plastic, the locking bolt 56 is appropriately of metal.

Figure 4:
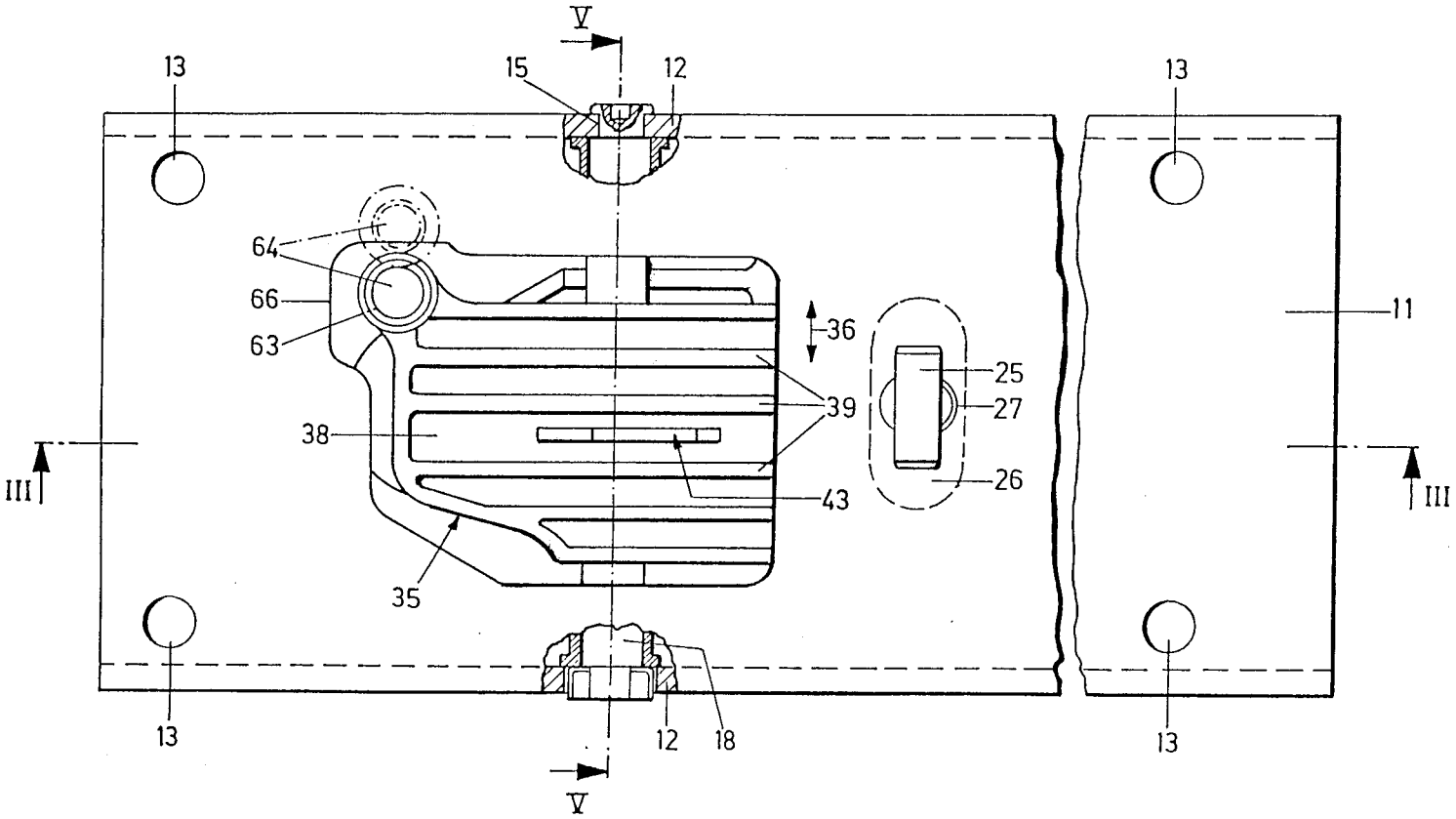
FIG. 4 is a plan view on the tilting apparatus, shown in partially cut-away fashion.
Figure 5:
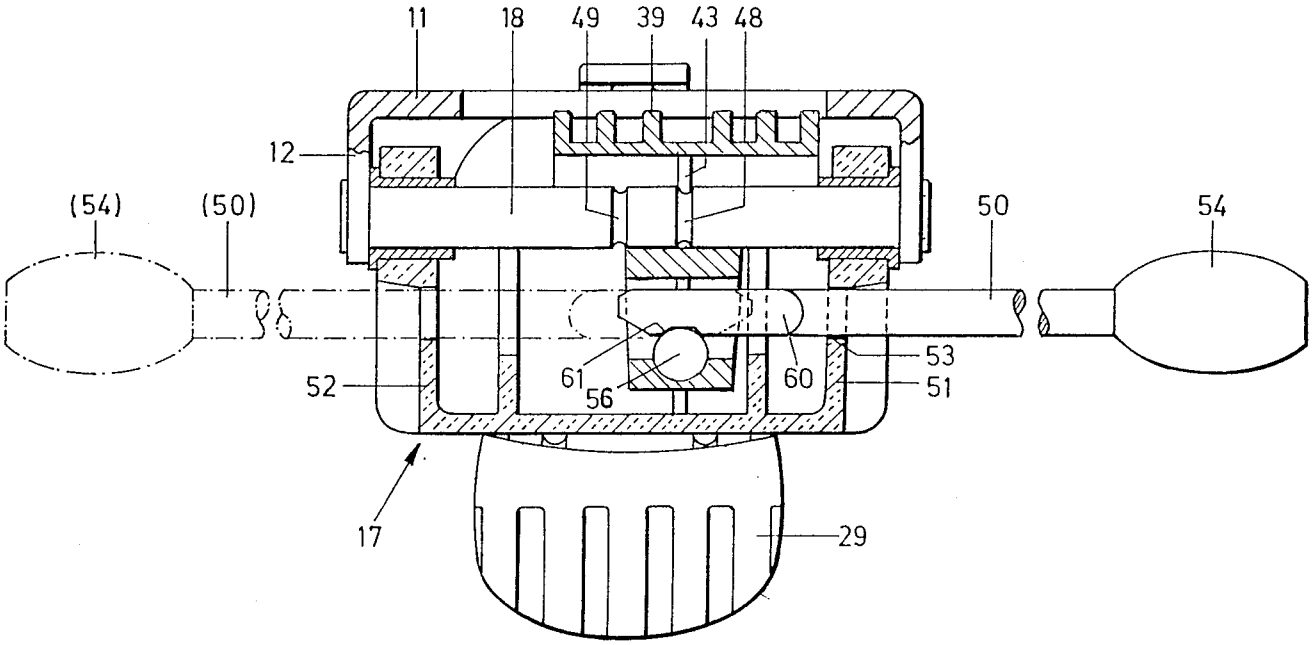
FIG. 5 is a vertical section taken through the tilting apparatus along the line V—V of FIG. 4.

A retention bolt 64 is disposed approximately vertically in a bore 63 of the slide 35, in fact in the vicinity of the actuation tongue 38, and rests with its underside on the body 17. In one horizontal terminal position of the slide 35, the upper end 65 of this retention bolt 64 is located in the vicinity of an opening 66 in the base plate 11. This is the terminal position in which the upper curve 45 of the spring 43 has engaged the recess 48, as shown in FIG. 5. In this terminal position, the base plate 11 can be pivoted into the position shown in FIG. 3 by dashed lines, counter to the force of the springs 30, 31, 32, until it strikes the stop face 33. In the other horizontal terminal position of the slide 35, the upper end 65 of the retention bolt 64 rests against the underside of the base plate 11, as shown in dashed lines in FIG. 4. This terminal position corresponds to the locking engagement of the recess 49 with the spring 43. In this second position of slide 35, tilting movement of base plate 11 is prevented. Any inclination of the chair seat 8 or 8' is thus precluded in this position.

Figure 6:
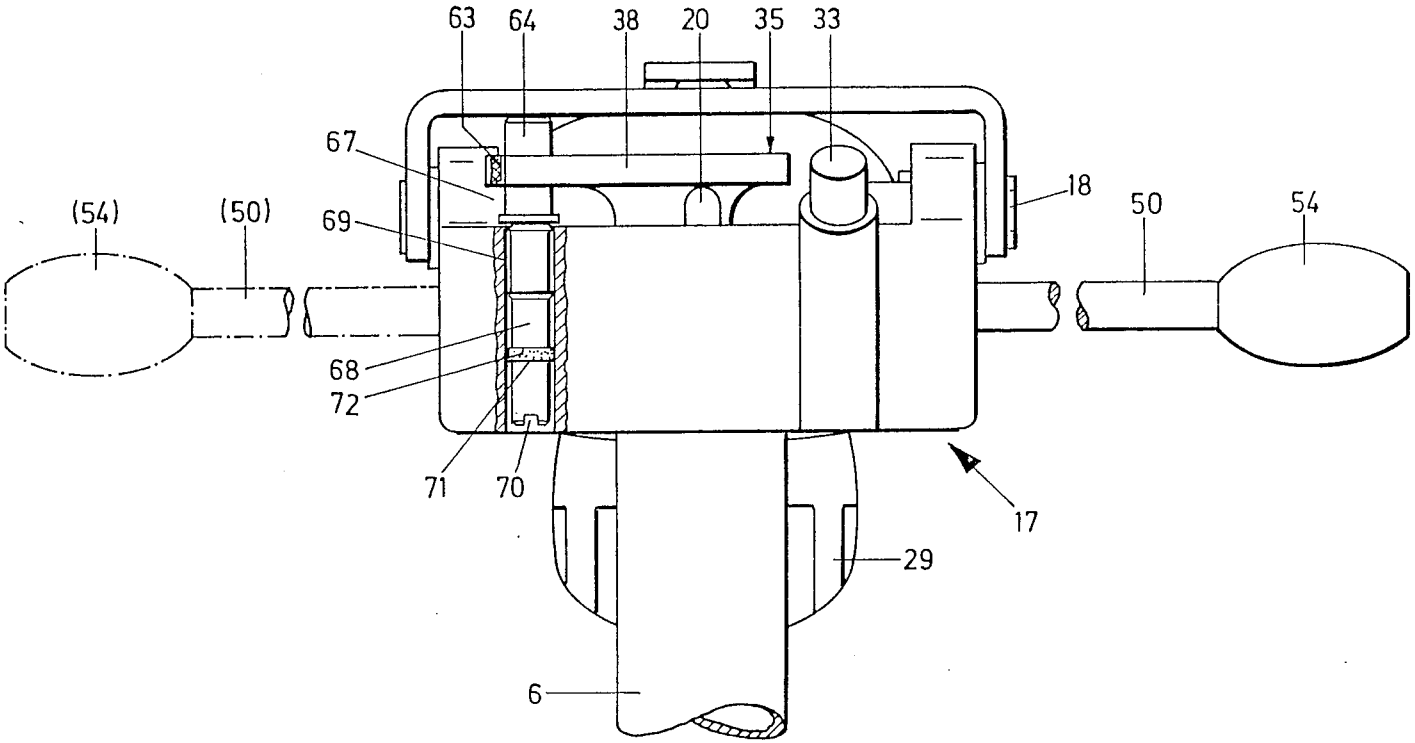
FIG. 6 is a front view of the tilting apparatus seen in the direction of the arrow VI in FIG. 3, shown in a partially cut-away representation.

In the locking position just described, the retention bolt 64 rests with its underside 67 on an adjusting bolt 68, which is disposed in a corresponding threaded bore 69 of the body 17 such that it is adjustable in its longitudinal direction. This adjusting bolt has a slit 70 on its free end protruding downward out of the body 17, so that an adjustment can be accomplished by means of a screwdriver or similar tool. An O ring 72 or the like is disposed in a groove 71 of the adjusting bolt 68, serving as a self-locking rotational fastening for the adjusting bolt 68. This adjusting bolt 68 may be adjusted in its axial length such that the retention bolt 64 rests practically without play against the base plate 11 on one end and against the adjusting bolt 68 on the other, so that in the retention position the base plate 11 will not wobble with respect to the chair seat 8 or 8', on the one hand, but nevertheless it is still possible to displace the slide 35 by means of the operating lever 50 while exerting only a moderate amount of force. As may be seen from FIG. 6, the retention bolt 64 is embodied as long enough that the vertical movements of the slide 35 in the pivoting direction 37 can be executed easily in order to actuate the releasing pin 20, and this can be accomplished in both horizontal terminal positions of the slide 35.

If it is desired that a chair be embodied as tiltable backward, as shown in FIG. 2, then the tilting apparatus is secured to the chair seat 8' in such a manner that the spring packet is disposed toward the front. The operating lever 50 in that case is secured in the manner shown in solid lines in FIG. 5. It then protrudes laterally toward the right hand of the user, as viewed from the standpoint of the user who is seated on the chair seat 8'.

If instead, however, the chair is to be embodied such that it tilts forward, as shown in FIG. 1, which is for example desirable in typing chairs, then the tilting apparatus is installed such that the spring packet is toward the back. In that case, as shown in dot-dash lines in FIG. 5, the operating lever is introduced through the opening 53 in the other lateral wall 52, and it engages the slide 35 in the manner described. The orientation of the operating lever 50 or in other words its position of use is identical in this instance to the case shown in FIG. 2. Only the directions of actuation for displacing the slide in the direction 36 are reversed in these two instances. The position of use may be the reverse of this as well (FIG. 1).

In both cases, adjustments in height are effected in the same manner by actuating the gas spring; that is, in order to press the releasing pin 20 into the gas spring, the handle 54 of the operating lever 50 is pulled upward. Since the operating lever is supported in the particular opening 53 serving as a bearing opening at a given time, the slide 35 is pivoted about the bearing surface 42, causing the actuation tongue 38 to press the releasing pin 20 into the gas spring. When the height adjustment is complete, that is, when the operating lever 50 is let go, the slide 35 is pressed back upward by the releasing pin 20, its farthest extent being such that the axial bolt 18 rests on the lower end of the oblong slot 41.

Should it be desired, the gas spring 6 can also be held in the receptacle 19 by means of a displaceable gripping device, as is described in German laid-open applications DE-OS No. 24 32 248 and DE-OS No. 24 28 776 (the latter corresponding to U.S. Pat. No. 3,995,824). An eccentric securing means as in German laid-open application DE-OS No. 28 36 666 (corresponding to U.S. Pat. No. 4,283,033) is also possible.

What is claimed is:

1. A lockable tilting apparatus for the seats of chairs, said apparatus comprising a base plate securable to a chair seat, said tilting apparatus comprising a stationary body member adapted to be supported by the pedestal of the chair, spring means supported by said stationary body member, means supported by said stationary body member mounting said base plate for tilting pivotal movement relative to said stationary body member, link means engaging and movable with said base plate against the restoring force of said spring means whereby said base plate is tiltably movable relative to said body member against the restoring force of said spring means; and wherein a locking appratus which is actuatable by displacement of an operating lever between two terminal positions is provided for selectively locking the base plate against tilting movement or for releasing the base plate for tilting movement, characterized by a slide member mounted in said body member for sliding movement relative to said base plate, said slide member being selectively movable between said two terminal positions, said slide member having receptacle means, said operating lever engaging said receptacle means, and defining means for selectively moving said slide member between said two terminal positions, said receptacle means being accessible for engagement by said operating lever from either of two laterally opposite sides of said body member, said body member being operatively connected to the body of said chair via a longitudinally adjustable gas spring, said operating lever being pivotably disposed in said body member for operating said longitudinally adjustable gas spring, and said slide member being displaceable by means of axial displacement of said operating lever.

2. An apparatus as defined by claim 1, characterized in that a corresponding bearing opening in said body member is associated with each of the opposite sides of said receptacle means.

3. An apparatus as defined by claim 1, characterized in that said operating lever is locked within said receptacle means of said slide member such that it is fixed against rotation but is releasable.

4. An apparatus as defined by claim 3, characterized in that a locking bolt which is passed through a matching lock mechanism recess in said operating lever to fix the lever against rotation, and which can be removed from this locking position counter to the force of a spring to permit rotation of the lever, is disposed in said receptacle means in said slide member.

5. An apparatus as defined by claim 1 in which said means supported by said stationary body member and mounting said base plate for tilting pivotal movement is an axial bolt which defines a pivotal shaft.

6. An apparatus as defined by claim 5, characterized in that said slide member is guided in a displaceable manner along said axial bolt.

7. An apparatus as defined by claim 6, characterized in that said slide member is displaceable between two terminal positions, in which a detent device releasably causes said slide member and said axial bolt to engage one another.

8. An apparatus as defined by claim 5, characterized in that said slide member is selectively pivotable about the axis of said axial bolt.

9. An apparatus as defined by claim 1, characterized in that a retention member is carried by said slide member, said retention member extending between said base plate and said body member in one of said terminal positions of said slide member whereby to prevent tilting movement of said base plate, said retention member being located below an opening in said base plate in the other of said terminal positions whereby to permit tilting movement of said base plate.

10. An apparatus as defined by claim 9, characterized in that said retention member, in one terminal position of said slide member, rests against an adjusting bolt disposed such that it is axially adjustable in said body member.

11. An apparatus as defined by claim 9, characterized in that said retention bolt is supported freely displaceably in said slide member.

12. An apparatus as defined in claim 1, characterized in that a plurality of spring means are supported by said stationary body member to provide a restoring force for said base plate.

13. An apparatus as defined in claim 1 which is mounted on a chair which tilts backward.

14. An apparatus as defined in claim 1 which is mounted as a chair which tilts forward.

15. A lockable tilting appratus for the seats of chairs, said apparatus comprising a base plate securable to a chair seat, said tilting apparatus comprising a stationary body member adapted to be supported by the pedestal of the chair, spring means supported by said stationary body member, means supported by said stationary body member mounting said base plate for tilting pivotal movement relative to said stationary body member, link means engaging and movable with said base plate against the restoring force of said spring means whereby said base plage is tiltably movable relative to said body member against the restoring force of said spring means; and wherein a locking apparatus which is actuatable by displacement of an operating lever between two terminal positions is provided for selectively locking the base plate against tilting movement or for releasing the base plate for tilting movement, characterized by a slide member mounted in said body member for sliding movement relative to said base plate, said slide member being selectively movable between said two terminal positions, said slide member having receptacle means, said opeating lever engaging said receptacle means, and defining means for moving said slide member selectively between said two terminal positions, said body member being operatively connected to the body of said chair via a longitudinally adjustable gas spring, said operating lever being pivotably disposed in said body member for operating said longitudinally adjustable gas spring, and said slide member being displaceable by means of axial displacement of said operating lever.

16. A lockable tilting apparatus for the seats of chairs, said apparatus comprising a base plate securable to a chair seat, said tilting apparatus comprising a stationary body member adapted to be supported by the pedestal of the chair, spring means supported by said stationary body member, means supported by said stationary body member mounting said base plate for tilting pivotal movement relative to said stationary body member, link means engaging and movable with said base plate against the restoring force of said spring means whereby said base plate is tiltably movable relative to said body member against the restoring force of said spring means; and wherein a locking apparatus which is actuatable by displacement of an operating lever between two terminal positions is provided for selectively locking the base plate against tilting movement or for releasing the base plate for tilting movement, characterized by a slide member mounted in said body member for sliding movement relative to said base plate, said slide member being selectively movable between said two terminal positions, said slide member having receptacle means, said operating lever engaging said receptacle means, and defining means for moving said slide member selectively between said two terminal positions, said means supported by said stationary body member and mounting said base plate for tilting pivotal movement comprising an axial bolt defining a pivotal shaft, and said slide member being guided in a displaceable manner along said axial bolt.

17. A lockable tilting apparatus for the seats of chairs, said apparatus comprising a base plate securable to a chair seat, said tilting apparatus comprising a stationary body member adapted to be supported by the pedestal of the chair, spring means supported by said stationary body member, means supported by said stationary body member mounting said base plate for tilting pivotal movement relative to said stationary body member, link means engaging and movable with said base plate against the restoring force of said spring means whereby said base plate is tiltably movable relative to said body member against the restoring force of said spring means; and wherein a locking apparatus which is actuatable by displacement of an operating lever between two terminal positions is provided for selectively locking the base plate against tilting movement or for releasing the base plate for tilting movement, characterized by a slide member mounted in said body member for sliding movement relative to said base plate, said slide member being selectively movable between said two terminal positions, said slide member having receptacle means, said operating lever engaging said receptacle means, and defining means for moving said slide member selectively between said two terminal positions, said body member being operatively connected to the body of said chair via a longitudinally adjustable gas spring, said operating lever being pivotably disposed in said body member for operating said longitudinally adjustable gas spring, said slide member being displaceable by means of axial displacement of said operating lever, said means supported by said stationary body member and mounting said base plate for tilting pivotal movement comprising an axial bolt defining a pivotal shaft, and said slide member being guided in a displaceable manner along said axial bolt.

18. A lockable tilting apparatus for the seats of chairs, said apparatus comprising a base plate securable to a chair seat, said tilting apparatus comprising a stationary body member adapted to be supported by the pedestal of the chair, spring means supported by said stationary body member, means supported by said stationary body member mounting said base plate for tilting pivotal movement relative to said stationary body member, link means engaging and movable with said base plate against the restoring force of said spring means whereby said base plate is tiltably movable relative to said body member against the restoring force of said spring means; and wherein a locking apparatus which is actuatable by displacement of an operating lever between two terminal positions is provided for selectively locking the base plate against tilting movement or for releasing the base plate for tilting movement, characterized by a slide member mounted in said body member for sliding movement relative to said base plate, said slide member being selectively movable between said two terminal positions, said slide member having receptacle means, said operating lever engaging said receptacle means, and defining means for moving said slide member selectively between said two terminal positions, and a retention member carried by said slide member, said retention member extending between said base plate and said body member in one of said terminal positions of said slide member whereby tilting movement of said base plate is prevented, said retention member beind located below an opening in said base plate in the other of said terminal positions whereby tilting movement of said base plate is permitted.

19. A lockable tilting apparatus for the seats of chairs, said apparatus comprising a base plate securable to a chair seat, said tilting apparatus comprising a stationary body member adapted to be supported by the pedestal of the chair, spring means supported by said stationary body member, means supported by said stationary body member mounting said base plate for tilting pivotal movement relative to said stationary body member, link means engaging and movable with said base plate against the restoring force of said spring means whereby said base plate is tiltably movable relative to said body member against the restoring force of said spring means; and wherein a locking apparatus which is actuatable by displacement of an operating lever between two terminal positions is provided for selectively locking the base plate against tilting movement or for releasing the base plate for tilting movement, characterized by a slide member mounted in said body member for sliding movement relative to said base plate, said slide member being selectively movable between said two terminal positions, said slide member having receptacle means, said operating lever engaging said receptacle means, and defining means for moving said slide member selectively between said two terminal positions, said body member being operatively connected to the body of said chair via a longitudinally adjustable gas spring, said operating lever being pivotably disposed in said body member for operating said longitudinally adjustable gas spring, said slide member being displaceable by means of axial displacement of said operating lever, and a retention member carried by said slide member, said retention member extending between said base plate and said body member in one of said terminal positions of said slide member whereby to prevent tilting movement of said base plate, said retention member being located below an opening in said base plate in the other of said terminal positions whereby to permit tilting movement of said base plate.

20. A lockable tilting apparatus for the seats of chairs, said apparatus comprising a base plate securable to a chair seat, said tilting apparatus comprising a stationary body member adapted to be supported by the pedestal of the chair, spring means supported by said stationary body member, means supported by said stationary body member mounting said base plate for tilting pivotal movement relative to said stationary body member, link means engaging and movable with said base plate against the restoring force of said spring means; and wherein a locking apparatus which is actuatable by displacement of an operating lever between two terminal positions is provided for selectively locking the base plate against tilting movement or for releasing the base plate for tilting movement, characterized by a slide member mounted in said body member for sliding movement relative to said base plate, said slide member being selectively movable between said two terminal positions, said slide member having receptacle means, said operating lever engaging said receptacle means, and defining means for moving said slide member selectively between said two terminal positions, said body member being operatively connected to the body of said chair via a longitudinally adjustable gas spring, said operating lever being pivotably disposed in said body member for operating said longitudinally adjustable gas spring, said slide member being displaceable by means of axial displacement of said operating lever, said means supported by said stationary body member and mounting said base plate for tilting pivotal movement comprising an axial bolt defining a pivotal shaft, said slide member being guided in a displaceable manner along said axial bolt, and a retention member carried by said slide member, said retention member extending between said base plate and said body member in one of said terminal positions of said slide member whereby to prevent tilting movement of said base plate, said retention member being located below an opening in said base plate in the other of said terminal positions whereby to permit tilting movement of said base plate.

* * * * *

UNITED STATES PATENT AND TRADEMARK OFFICE

CERTIFICATE OF CORRECTION

PATENT NO. : 4,555,085

DATED : November 26, 1985

INVENTOR(S) : BAUER et al.

It is certified that error appears in the above-identified patent and that said Letters Patent is hereby corrected as shown below:

Insert the following:

[30] Foreign Application Priority Data:

Nov. 17, 1981 [DE] Fed. Rep. of Germany P 31 45 579.4

Sep. 24, 1982 [DE] Fed. Rep. of Germany P 32 35 361.8

Signed and Sealed this

*Sixteenth* Day of *September 1986*

[SEAL]

*Attest:*

DONALD J. QUIGG

*Attesting Officer*

*Commissioner of Patents and Trademarks*